US005820123A

United States Patent [19]

Gihr et al.

[11] Patent Number: 5,820,123

[45] Date of Patent: Oct. 13, 1998

[54] METHOD AND DEVICE FOR ALIGNING A SHEET ON A FEEDER TABLE OF A SHEET-FED ROTARY PRINTING PRESS

[75] Inventors: Detlef Gihr, Heidelberg; Siegfried Kurtzer, Mannheim, both of Germany

[73] Assignee: Heidelberger Druckmaschinen AG, Heidelberg, Germany

[21] Appl. No.: 931,546

[22] Filed: Sep. 15, 1997

Related U.S. Application Data

[63] Continuation of Ser. No. 587,723, Jan. 19, 1996, abandoned.

[30] Foreign Application Priority Data

Jan. 21, 1995 [DE] Germany ..... 195 01 798.6

[51] Int. Cl.[6] ..... B65H 9/00

[52] U.S. Cl. ..... 271/236; 271/249; 271/252; 271/253; 271/254

[58] Field of Search ..... 271/236, 238, 271/239, 248, 249, 250, 252, 253, 254

[56] References Cited

U.S. PATENT DOCUMENTS

| | | | |
|---|---|---|---|
| 3,624,807 | 11/1971 | Schwebel | 271/236 |
| 3,754,755 | 8/1973 | Krochert . | |
| 4,451,029 | 5/1984 | Wildmann et al. . | |
| 4,533,134 | 8/1985 | Galster | 271/238 |
| 4,874,160 | 10/1989 | Yamamoto | 271/253 |
| 4,896,875 | 1/1990 | Gotschewski | 271/236 |
| 5,267,728 | 12/1993 | Simeth | 271/236 |
| 5,464,206 | 11/1995 | Rodi et al. | 271/239 |

FOREIGN PATENT DOCUMENTS

| | | | |
|---|---|---|---|
| 0 601 607 | 6/1994 | European Pat. Off. . | |
| 644780 | 10/1928 | France | 271/250 |
| 839 644 | 5/1952 | Germany . | |
| 2 137 661 | 2/1973 | Germany . | |
| 31 31 279 | 6/1985 | Germany . | |
| 35 21 691 | 2/1986 | Germany . | |
| 300970 | 11/1954 | Switzerland | 271/250 |
| 376554 | 7/1932 | United Kingdom | 271/250 |
| 720408 | 12/1954 | United Kingdom | 271/250 |

*Primary Examiner*—H. Grant Skaggs
*Attorney, Agent, or Firm*—Herbert L. Lerner; Laurence A. Greenberg

[57] ABSTRACT

Method for laterally aligning a sheet to be aligned at front lays in a revolving direction of the sheet includes, in a first alignment step, moving the sheet against a side stop; in a second alignment step, moving the sheet against front lays; and in a third alignment step, moving the sheet a second time against the side stop; and device for performing the method.

9 Claims, 2 Drawing Sheets

METHOD AND DEVICE FOR ALIGNING A SHEET ON A FEEDER TABLE OF A SHEET-FED ROTARY PRINTING PRESS

This application is a continuation of application Ser. No. 08/587,723, filed on Jan. 19, 1996 now abandoned.

BACKGROUND OF THE INVENTION

FIELD OF THE INVENTION

The invention relates to a method for aligning a sheet on a feeder table of a sheet-fed rotary printing press and, more particularly, for laterally aligning a sheet of paper in a direction of revolution thereof at front lays on the feeder table.

The use of front lays and side lays for sheet alignment has long been known in printing press design and is described, for example, in German Published, Non-Examined Patent Application (DE-AS) 21 37 661. This reference shows a device with which a sheet, which has been fed up against front lays, is initially aligned thereby in a revolving direction of the sheet and thereafter laterally aligned by means of a drawing or pulling device. The pulling device conventionally has a pulling or drawing element, which is movable crosswise to the sheet transport direction, and a cyclically controlled contact pressure roller cooperating therewith.

In the device of DE-AS 21 37 661, it is disadvantageous that all of the lateral alignment is performed after the alignment of the sheets in the revolving direction thereof because, as is known for presses operating with high rotary speeds, only little time remains for pulling the sheets against the side lays. If the pulling paths are long, the sheet previously aligned at the front lays may be pulled away therefrom again.

SUMMARY OF THE INVENTION

It is an object of the invention is to provide a method and a device for aligning a sheet on a feeder table of a sheet-fed rotary printing press, i.e., for feeding sheets in-register to a sheet-fed printing press.

With the foregoing and other objects in view, there is provided in accordance with one aspect of the invention, a method for laterally aligning a sheet to be aligned at front lays in a revolving direction of the sheet, comprising, in a first alignment step, moving the sheet against a side stop; in a second alignment step, moving the sheet against front lays; and in a third alignment step, moving the sheet a second time against the side stop.

In accordance with another mode, the method according to the invention includes, in the third alignment step, moving the sheet against another side stop.

In accordance with a further mode of the method according to the invention, the sheet is moved against the side stop by pulling the sheet thereagainst.

In accordance with another aspect of the invention, there is provided a device for laterally aligning a sheet to be aligned at front lays in a revolving direction of the sheet, comprising a pulling device for laterally moving the sheet against a side lay, a contact roller bringable into operative connection with the pulling device, and a control cam having two strokes for controlling movement of the contact roller.

In accordance with a further feature of the invention, the side lay has two side stops.

In accordance with an added feature of the invention, the side stops are disposed offset from one another transversely to sheet transport direction.

In accordance with an additional feature of the invention, the side stops are arranged within one another.

In accordance with yet another feature of the invention, the side stops are disposed side by side.

In accordance with yet a further feature of the invention, at least one the side stops is disposed so as to be movable into two end positions.

In accordance with a concomitant feature of the invention, the end positions of the one side stop are adjustable.

In the method of the invention, it is advantageous that the conventionally provided side lay be used for lateral prealignment of the sheet before the circumferential alignment. This prealignment is performed enormously fast, which makes it possible to achieve high press speeds. After the circumferential alignment, a fine correction of the lateral alignment takes place, the circumferential registration being no longer demonstrably affected. In the simplest mode of the method according to the invention, the sheet is pulled toward the same side stop both in the prealignment and in the fine correction operations.

In an improved mode according to the method, in the second pulling operation for fine correction, pulling is performed toward and against a laterally offset second stop. Advantageously, the sheet to be processed can relax or be stress-relieved laterally in both directions during the two operations.

In an advantageous feature of the invention, it is possible to provide a side stop which is changed in position after the prealignment (coarse alignment), for example, by shifting the stop within the side lay, or by shifting the entire side lay including the stop. After the prealignment has been effected, the stop for the coarse alignment pivots out of the sheet transport plane and clears the way for the fine stop.

Another possibility is for the coarse stop to be shifted laterally behind the side stop.

Other features which are considered as characteristic for the invention are set forth in the appended claims.

Although the invention is illustrated and described herein as a method and a device for aligning a sheet on a feeder table of a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
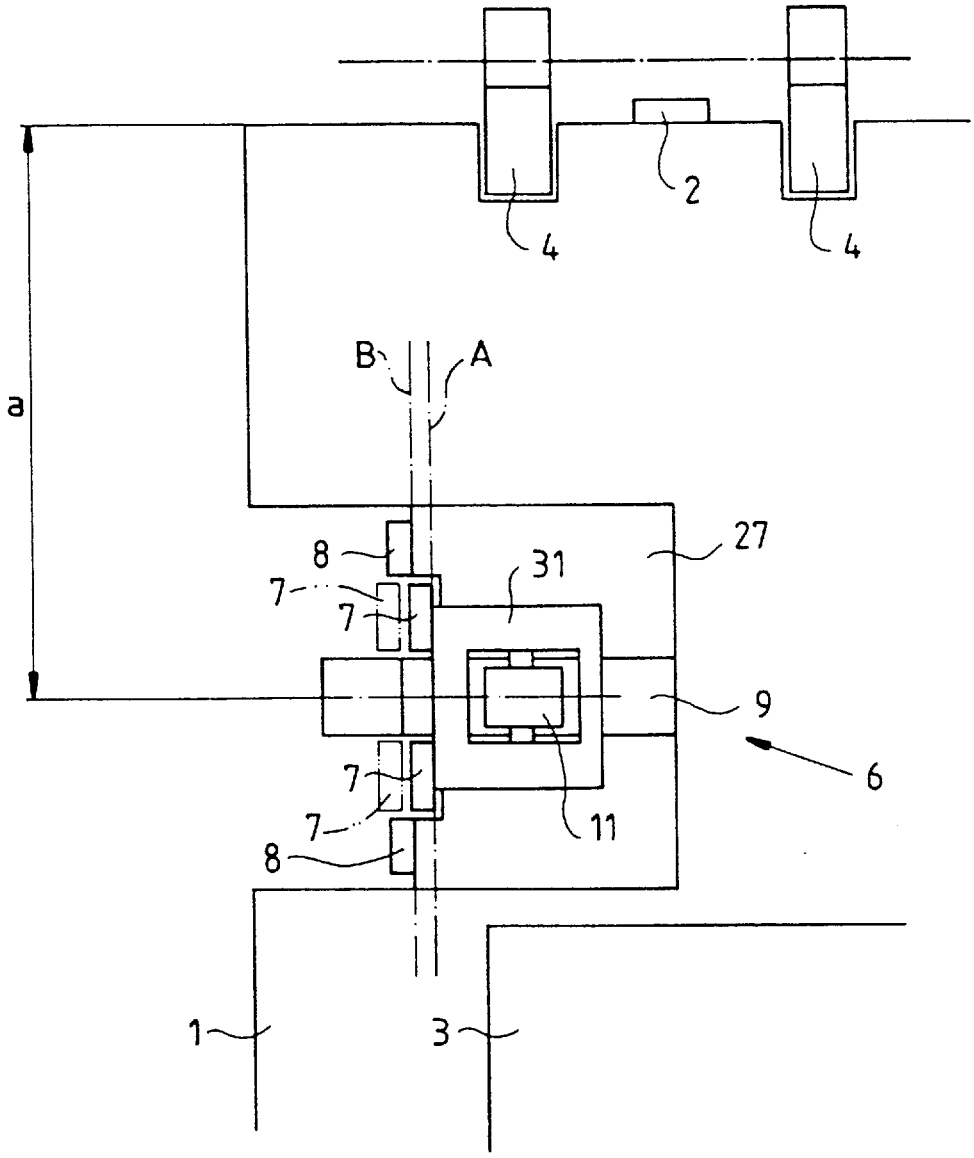
FIG. 1 is a diagrammatic top plan view of a device for aligning a sheet on a feeder table of a sheet-fed rotary printing press in accordance with the invention.
Figure 2:
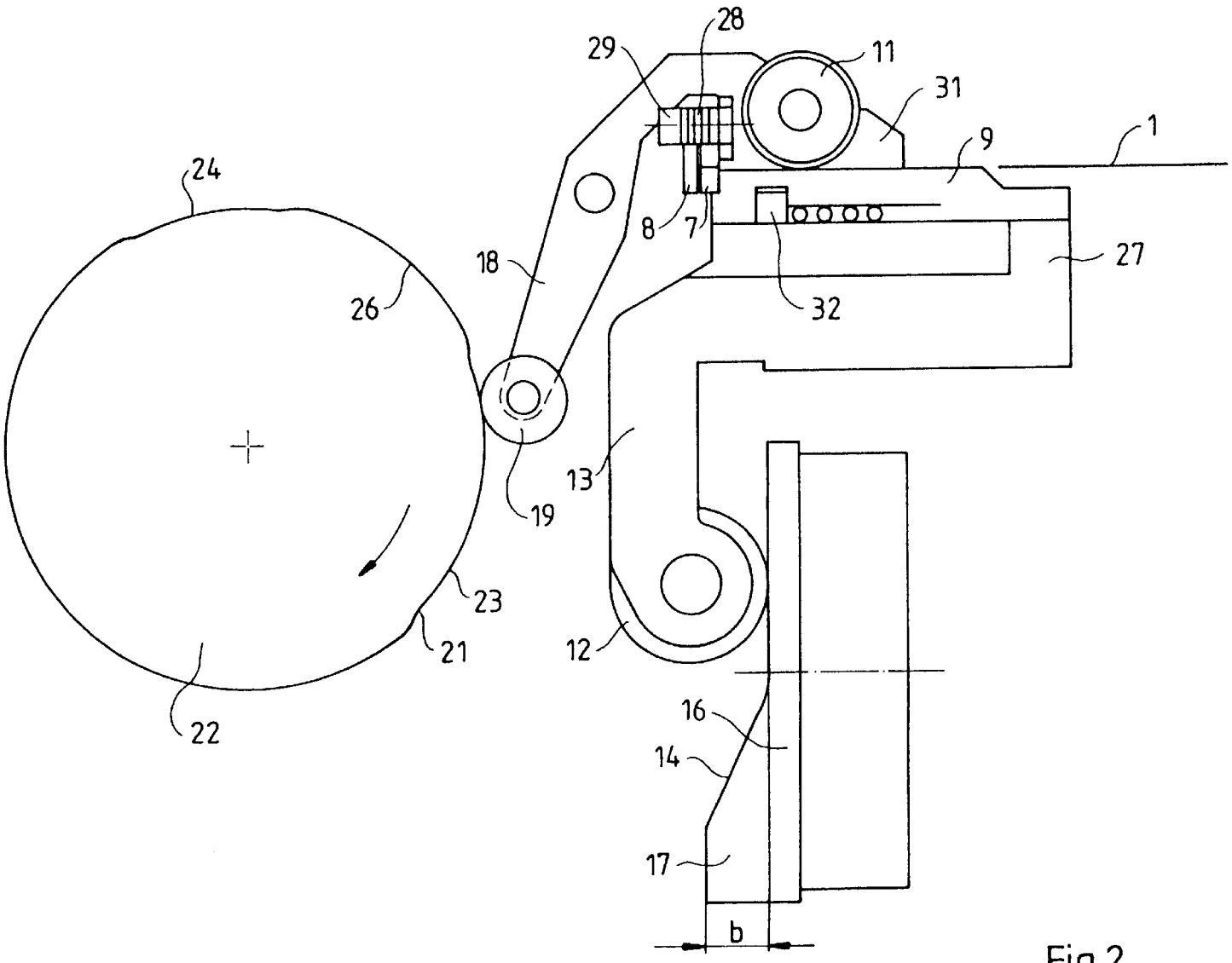
FIG. 2 is a diagrammatic side elevational view of the device illustrating a pulling device with control disks forming part of the sheet-aligning device according to the invention.

Referring now to the figures of the drawings, there is shown therein a feeder table 1 for a sheet-fed rotary printing press having front lays 2 conventionally disposed in a forward region thereof; at these front lays 2, a sheet 3 is aligned in circumferential direction before being engaged by pregrippers 4, pulled from the feeder table 1, and transferred for processing to the sheet-fed rotary printing press. Spaced at a distance ahead of or before the front lays 2, as viewed in the sheet travel direction from the bottom to the top of FIG. 1, for example, pulling devices 6 for laterally moving the sheets 3, and side stops 7 and 8 for aligning the sheets 3 are provided on both sides of the feeder table 1, only the left-hand side of which is shown in FIG. 1. Depending upon whether the sheets 3 to be processed are to be aligned on the left-hand or the right-hand side thereof, the respective oppositely disposed pulling device is turned off. Because the pulling devices 6 on the left-hand and the right-hand sides are mirror-symmetrically identical, the invention will be described herein only for the pulling device 6 disposed on the left-hand side. Thus, the pulling device 6 is formed primarily of a pulling rail 9 inserted into the feeder table 1 and a pulling roller 11 arranged so as to be downwardly swivelable and bringable into operative connection with the pulling rail 9. The pulling rail 9 is supported so as to be displaceable crosswise to the sheet transport direction, the pulling motion being initiated by a control roller 12 which is rotatably supported on an arm 13 of the pulling rail 9. The control roller 12 cooperates with a control surface 14 at an end face of a control disk 16 driven in accordance with the operating cycle of the printing press. The control disk 16 has a control cam 17, the height b of which is the standard for the pulling or traction path.

The pulling roller 11 is rotatably supported or journalled at the end of a lever 18 which is swivellably supported approximately at the center thereof. At the other end of the lever 18, a rotatably supported or journalled control roller 19 is provided which is in rolling contact with a control surface 21 of a control disk 22 drivable in accordance with the operating cycle of the printing press. The control disk 22 is formed with two control troughs or valleys 23 and 24.

For effecting a lateral prealignment of the sheet 3, the pulling roller 11 is lowered in a direction towards the pulling rail 9. The control roller 19 rolls along the control surface 21 in the region of the control trough 23. After the lateral prealignment of the sheet 3 has been performed, the control roller 19 is lifted away from the pulling rail 9 and releases the sheet 3 so that this sheet can be aligned unhindered at the front lays 2 in the circumferential direction of travel of the sheet 3. The control roller 19 thereat is in contact with the control surface 21 in a region 26 between the control troughs 23 and 24. After the circumferential alignment of the sheet 3, the control roller 19 comes into contact with the control surface 21 in the region of the control trough 24. As a result, the pulling roller 11 is again lowered onto the pulling rail 9 in order to introduce a fine lateral alignment.

As shown in FIG. 1, the lateral or side stop 8 for the fine alignment of the sheet 3 is mounted at a pull lay housing 27. For the purpose of format adjustment, the entire pulling device 6 with the pull lay housing 27 is disposed so as to be displaceable by means of a non-illustrated spindle transversely or crosswise to the sheet transport direction. The side stop 7 is supported so as to be displaceable counter to the force of cup-spring packages 28 provided on a bolt 29 on a pulling roller housing 31. An entrainer or drives 32 is provided on the pulling rail 9 and, together with the pulling rail 9, is displaceably supported. In an end region of the travel motion of the pulling rail 9, the driver or entrainer 32 comes into contact with the side stop 7 and displaces it counter to the force of the cup-spring package 28 out of a first end position represented by a plane A which is defined by the side stops 7, to a second end position represented by a plane B which is defined by the side or lateral stops 8.

It is also possible to shift the side stop 7 to a location behind, i.e., on the other side of the plane B, as viewed in FIG. 1, as shown in phantom therein.

The sheet 3 to be finely aligned after the coarse alignment operation is then no longer hindered by the side stop 7 from reaching the side stop 8. It is also obviously possible for the side stop 7 to be pivoted out of the alignment plane defined by the feed table 1.

A further possible embodiment calls for providing only the fine stop 8 and pulling the sheet against the same fine stop 8 twice.

Instead of providing the respective two side stops 7 and 8, the possibility also exists of providing only one respective side stop 7 or 8.

In that case, the side stops 7 and 8 can, for example, be disposed side by side or adjacent one another, as well. The stationary side stops 8 and the movable side stops 7 are adjustable into the end positions thereof by means of non-illustrated conventional adjusting means.

We claim:

1. Method for laterally aligning a sheet to be aligned at front lays in a transport direction of the sheet, comprising, in a first alignment step, moving the sheet against a first side stop; in a second alignment step, moving the sheet against front lays; and in a third alignment step, moving the sheet against a second side stop offset relative to the first side stop.

2. Method according to claim 1, wherein the sheet is moved against the first and second side-stops by pulling the sheet thereagainst.

3. Device for laterally aligning a sheet to be aligned at front lays in transport direction of the sheet, comprising a pulling device for laterally moving the sheet against a side lay, a contact roller bringable into operative connection with said pulling device, and a control cam having four strokes for controlling movement of said contact roller.

4. Aligning device according to claim 3, wherein the side lay has two side stops.

5. Aligning device according to claim 4, wherein said side stops are disposed offset from one another transversely to sheet transport direction at certain times during operation of the aligning device.

6. Aligning device according to claim 5, wherein said side stops include a first side stop and a second side stop, and wherein said first side stop is aligned with said second side stop during certain operational times of the aligning device.

7. Aligning device according to claim 5, wherein said side stops are disposed side by side.

8. Aligning device according to claim 3, wherein said side stops include a first side stop and a second side stop and said first side stop is disposed so as to be movable into two end positions.

9. Aligning device according to claim 8, wherein said end positions of said first side stop is adjustable.

* * * * *